US005143105A

United States Patent [19]

Katayama

[11] Patent Number: 5,143,105

[45] Date of Patent: Sep. 1, 1992

[54] CLEANING DEVICE FOR TUBE

[76] Inventor: Shinzou Katayama, Park.Komo 201, No. 15-10, Minaminagareyama 3-chome, Nagareyama-shi, Chiba-ken, 270-01, Japan

[21] Appl. No.: 743,638

[22] Filed: Aug. 12, 1991

[51] Int. Cl.[5] ..... B08B 3/02

[52] U.S. Cl. ..... 134/167 C; 134/172; 134/179; 239/265.11

[58] Field of Search ..... 134/172, 167 R, 176, 134/179, 166 R; 239/265.11, 265.23

[56] References Cited

U.S. PATENT DOCUMENTS

| | | | |
|---|---|---|---|
| 1,308,469 | 7/1919 | Amet | 134/167 C X |
| 1,444,889 | 2/1923 | Sladden | 134/167 C |
| 1,587,194 | 6/1926 | Sladden | 134/167 C |
| 1,803,425 | 5/1931 | Cunningham | 134/167 C |
| 4,073,302 | 2/1978 | Jones | 134/167 C |
| 4,206,313 | 6/1980 | Cavoretto | 134/167 C |
| 4,237,913 | 12/1980 | Maasberg | 134/167 C |
| 4,361,282 | 11/1982 | DiVito | 134/167 C X |
| 4,699,163 | 10/1987 | Baziuk | 134/167 C |
| 4,985,763 | 1/1991 | Fraser | 134/167 C |

*Primary Examiner*—Frankie L. Stinson

*Attorney, Agent, or Firm*—Edwin E. Greigg; Ronald E. Greigg

[57] ABSTRACT

A cleaning device for a tube of this invention comprises a nozzle supporting body fixedly attached to the insertion end portion of a cleaning hose adapted to be inserted into the tube in order to allow the cleaning device to be self-propelled and to allow a nozzle to be easily guided along the inner peripheral wall of the tube, the nozzle supported by the nozzle supporting body and having a first injection hole directed toward the inner wall of the tube, and an elongated nozzle guide member one end portion of which is fixedly to the nozzle, wherein second injection holes are formed in an oblique direction at the tubular portion of the nozzle supporting body so as to permit the cleaning device to be self-propelled.

4 Claims, 8 Drawing Sheets

CLEANING DEVICE FOR TUBE

BACKGROUND OF THE INVENTION

This invention relates to a cleaning device for a tube used as piping of a structure such as mansion or building, etc.

PRIOR ART

Hitherto, as an embodiment of a cleaning device of this kind, there is the invention previously proposed by the inventor of this invention.

As shown in FIG. 9, the cleaning device of the above-mentioned earlier invention comprises a nozzle supporting body 3 attached to an insertion end portion 2*a* of a cleaning hose 2 adapted to be inserted into a tube 1, and a nozzle 5 supported by the nozzle supporting body and having a plurality of injection holes 8 directed toward the inner wall of the tube wherein the nozzle 5 is formed in a manner bent relative to the nozzle supporting body 3, and a large number of injection holes 8*a*, 8*b* and 8*c* are formed, as the injection holes 8, at the front end portion of the nozzle 5 in order to permit an unbalanced thrust to be exerted on the nozzle 5.

However, since the cleaning device constructed above is not of a self-propelled or advancing structure, an operation to positively force the cleaning hose 2 into the inner part of the piping is required. In addition, since cleaning of the piping exclusively relies on only cleaning water injected from the injection holes 8, there was a limit in increase in the cleaning force.

SUMMARY OF THE INVENTION

With the drawbacks with the prior art as described above in view, an object of this invention is to provide a cleaning device for a tube capable of rendering a self-advancing or propelling force for drawing or tracking a cleaning hose to the cleaning device itself, and capable of further increasing the cleaning force.

To achieve the above-mentioned object, a cleaning device for a tube of this invention is characterized by the provision of a nozzle supporting body fixedly attached to the insertion end portion of a cleaning hose adapted to be inserted into the tube, a nozzle supported by the nozzle supporting body and having a first injection hole directed toward the inner wall of the tube, and an elongated nozzle guide member one end portion of which is fixedly attached to the nozzle, wherein a second injection hole or holes are formed in an oblique direction at the tubular portion of the nozzle supporting body so as to permit the cleaning device to be self-propelled.

BRIEF DESCRIPTION OF THE DRAWINGS

FIGS. 1 to 8 are explanatory views showing an embodiment of this invention wherein FIG. 1 is a perspective view, FIG. 2 is a schematic cross sectional view, FIG. 3 is a cross sectional view taken along the line 3—3 of FIG. 2, FIG. 4 is a cross sectional view taken along the line 4—4 of FIG. 2, and FIGS. 5 to 8 are explanatory views of the operating state.

DESCRIPTION OF THE PREFERRED EMBODIMENT

Figure 1:
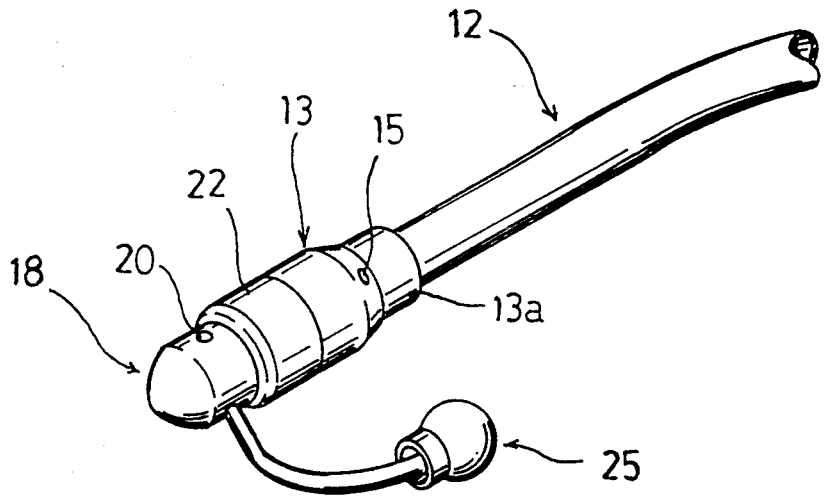
Figure 2:
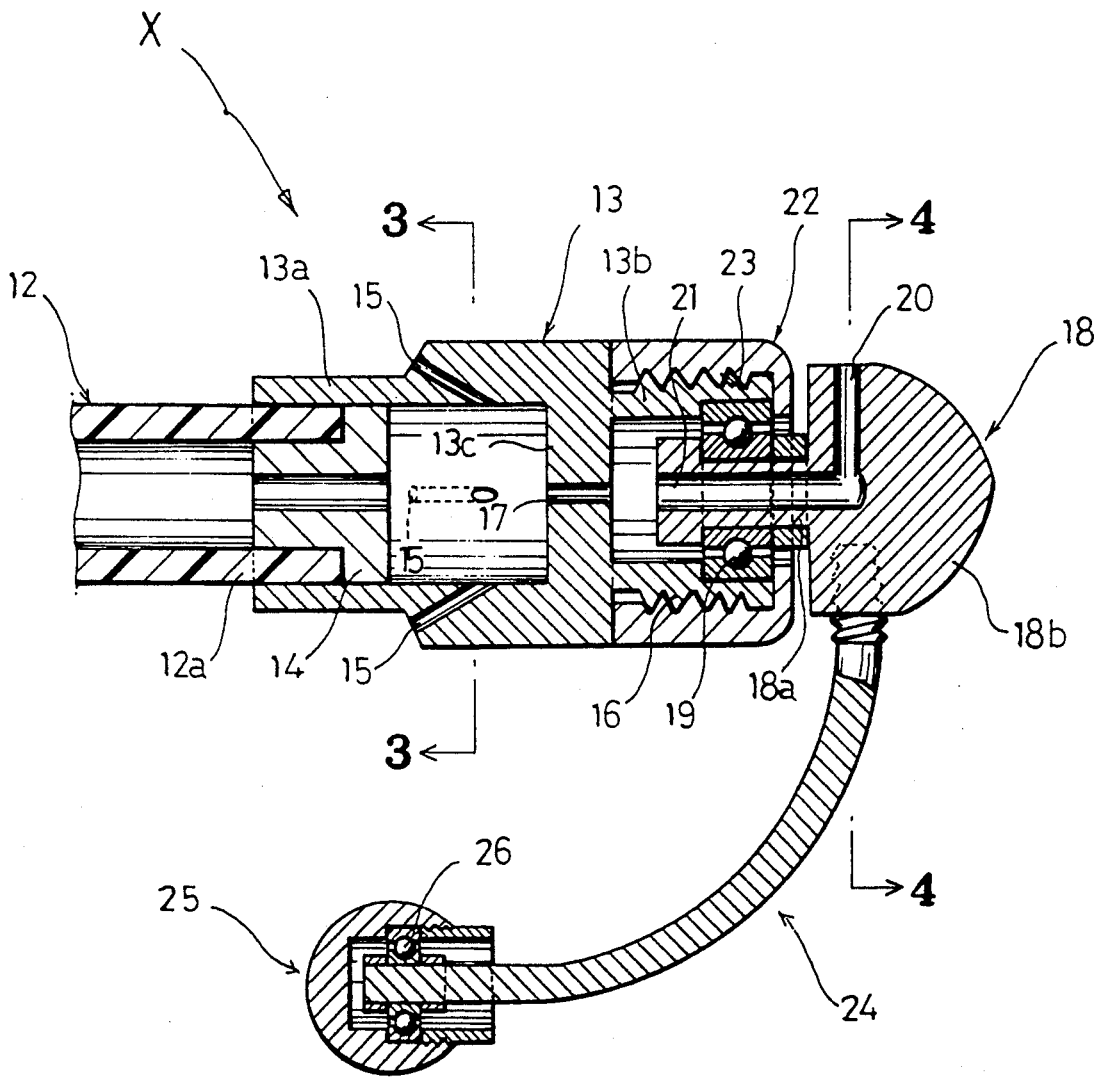

A preferred embodiment of this invention will now be described in detail with reference to the attached drawings.

In FIGS. 1 to 8, reference numeral 11 denotes a tube used as piping of a structure such as mansion or building, etc. This tube 11 includes a plurality of bent portions.

Reference numeral 12 denotes a cleaning hose one end portion of which is connected to a pump (not shown) provided outside the tube 11, while the other end portion thereof is inserted into the tube 11.

Reference numeral 13 denotes a nozzle supporting body in which the opening end portion of an one end side tubular portion 13*a* is fixedly fitted over an insertion end portion 12*a* of the cleaning hose 12. This nozzle supporting body 13 is formed by metal or rigid synthetic resin. The cleaning hose 12 is connected to the one end side tubular portion 13*a* of the nozzle supporting body 13 by means of an inner tube fixing appliance 14 internally provided at the portion close to the one end opening portion of the nozzle supporting body 13.

Figure 3:
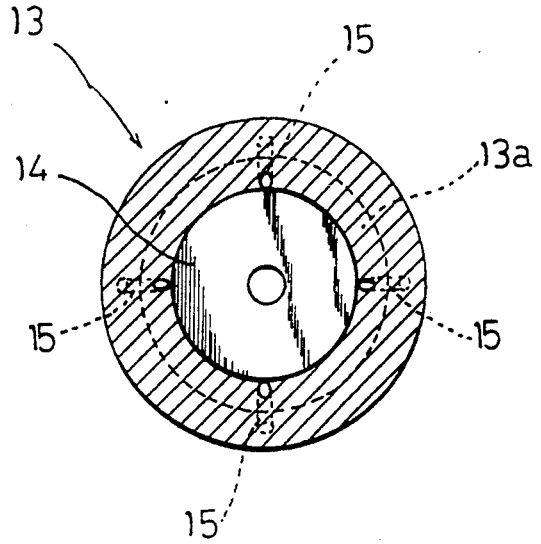

Reference numeral 15 denotes second injection holes for allowing a cleaning device X to be self-propelled, which are formed in an oblique direction at the one end side tubular portion 13*a* of the nozzle supporting body 13. These second injection holes 15 are directed to the cleaning hose 12 side. In this embodiment, four second injection holes in total are formed as shown in FIG. 3.

Reference numeral 13*b* denotes the other end side tubular portion of the nozzle supporting body 13. A male screw 16 is formed on the outer peripheral wall of the other end side tubular portion 13*b*.

Reference numeral 13*c* denotes a partition wall formed at the central portion of the nozzle supporting body 13 and including a flow path 17 of liquid at the center portion of the partition wall.

Reference numeral 18 denotes a nozzle attached to the opening portion of the other end side tubular portion 13*b* of the nozzle supporting body 13. This nozzle 18 is rotatably supported by the nozzle supporting body 13 through a mini-bearing 19 internally provided between the other side tubular portion 13*b* of the nozzle supporting body 13 and an annular recess formed in a circumferential direction at the outer peripheral wall of a neck portion 18*a* of the nozzle.

Figure 4:
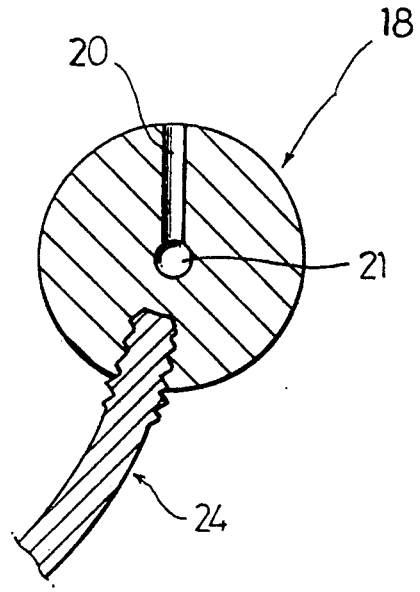

Reference numeral 20 denotes a single first injection hole formed at a head portion 18*b* of the nozzle and is directed to the inner wall of the tube 11. The first injection hole 20 is formed in a direction perpendicular to a nozzle introduction hole 21 as shown in FIG. 4.

It is to be noted that a plurality of first injection holes 20 may be provided.

Reference numeral 22 denotes a tubular supporting cap for protecting the nozzle 18 from being detached from the nozzle supporting body 13 through the mini-bearing 19. At the outside wall of the supporting cap 22, a throughhole through which the neck portion 18*a* of the nozzle is penetrated is formed. Further, at the inner peripheral wall, a female screw 23 screw-connected to the male screw 16 of the nozzle supporting body 13 is formed.

Reference numeral 24 denotes an elongated nozzle guide member one end portion of which is screw-connected to the head portion 18*b* of the nozzle 18. This elongated nozzle guide member 24 has a resilient force.

Further, the elongated nozzle guide member 24 extends obliquely toward the cleaning hose 12 side.

It should be noted that as long as the nozzle guide member 24 has a function to guide the nozzle 18 along the inner peripheral wall of the tube 11, material, number, shape and direction of the nozzle guide member 24 are not elements particularly limiting the range of the invention.

Reference numeral 25 denotes a slide member rotatably attached to the free end portion of the nozzle guide member 24. This slide member slides on the inner peripheral wall 11*a* of the tube 11. In this embodiment, a rotary spherical body having a bearing 26 therein is used as the slide member 25.

Figure 5:
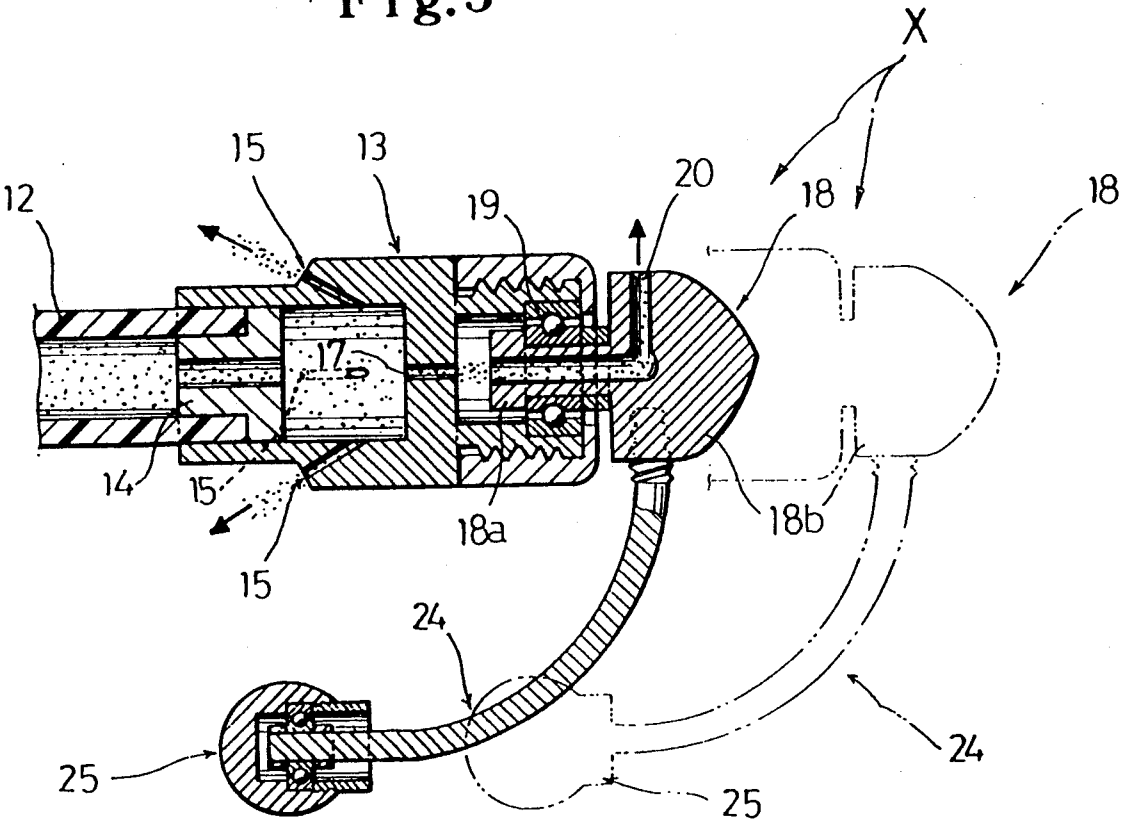
Figure 6:
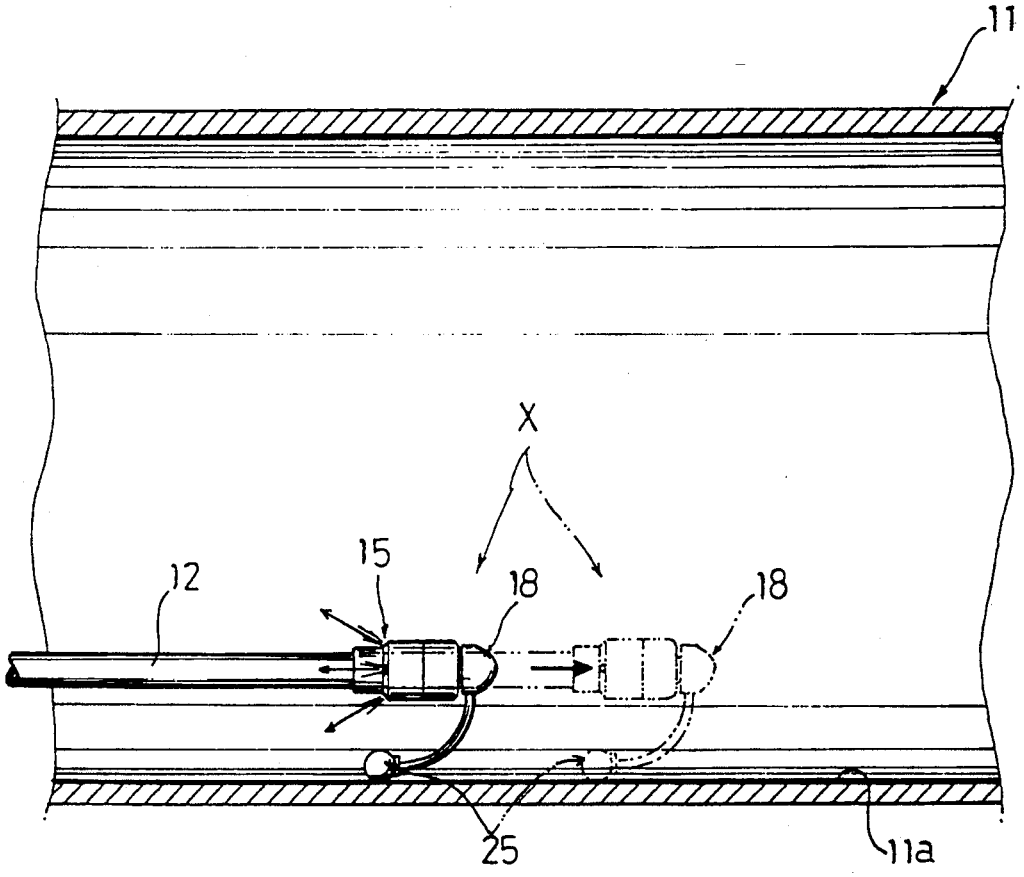

In the above-described configuration, when cleaning water of a high pressure is delivered from a pump (not shown) into the cleaning hose 12, cleaning water first flows from the insertion end portion 12*a* of the cleaning hose 12 into the one end side tubular portion 13*a* of the nozzle supporting body 13. Then, a portion of the cleaning water is injected from the second injection holes 15 as shown in FIG. 5. As a result, the cleaning device X is self-propelled while drawing the cleaning hose 12 toward the inner part of the tube as shown in FIG. 6.

Figure 7:
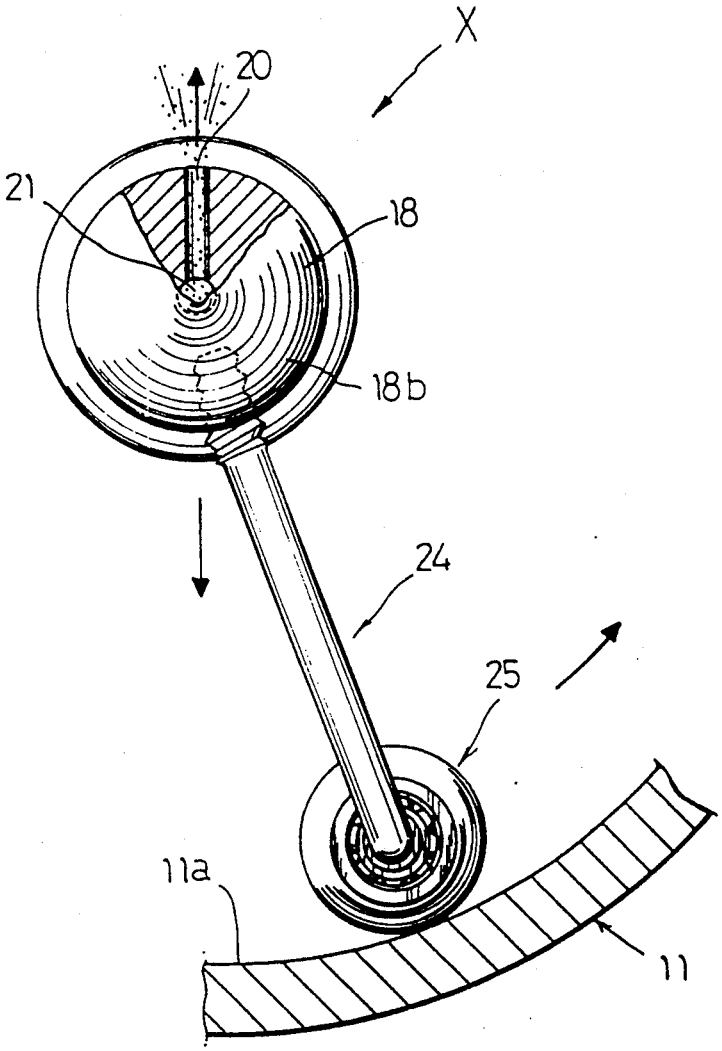
Figure 8:
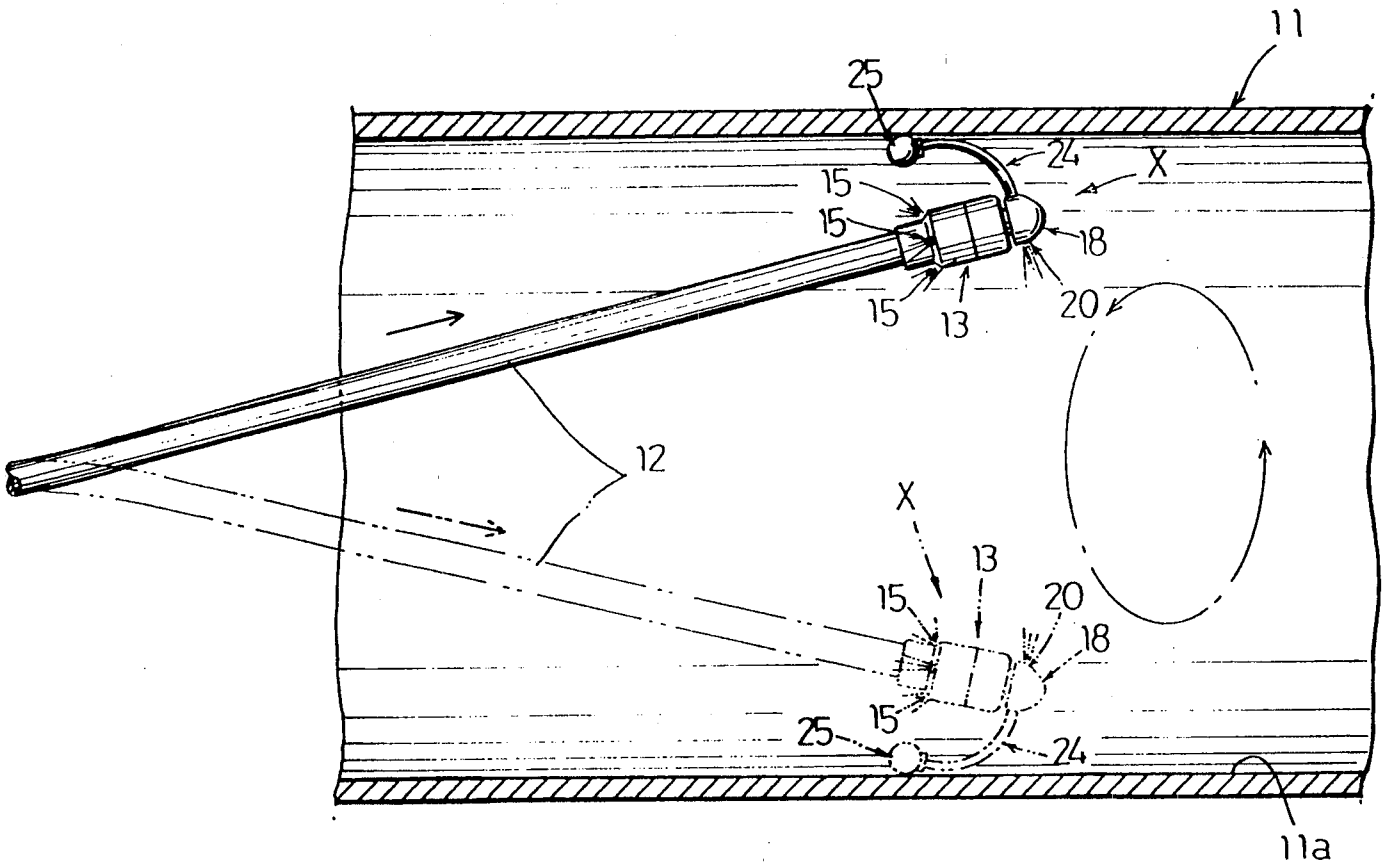
Figure 9:
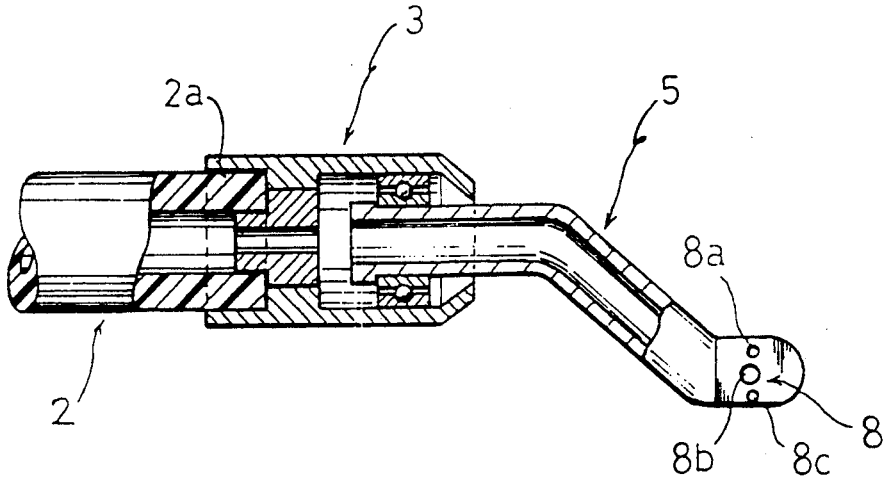
Fig. 9 PRIOR ART
FIG. 9 is an explanatory view showing an embodiment of the prior art.

On the other hand, cleaning water flows into the other side tubular portion 13*b* passing through the flow path 17 of the nozzle supporting body 13, and is then injected from the first injection hole 20. Thus, when cleaning water is injected from the first injection hole 20, an unbalanced thrust is exerted on the nozzle 18, so the nozzle 18 moves in a direction of the inner wall 11*a* of the tube 11 as shown in FIG. 7. Thus, the slide member 25 of the nozzle guide member 24 comes into contact with the inner wall 11*a*. At this time, the slide member 25 is thrust against the inner wall 11*a* by an injection reaction force of the nozzle to produce a torque or turning force. As a result, the nozzle 18 moves, while injecting cleaning water, along the inner peripheral wall of the tube 11 as shown in FIG. 8. Even if the tube has a large diameter as shown in FIG. 8, the nozzle 18 rotates without being away from the inner peripheral wall of the tube.

As is clear from the foregoing description, this invention has the advantages or effects as recited below.

(1) Since this cleaning device has second injection holes, it is possible to render a self-propelling force for drawing the cleaning hose to the cleaning device itself. Further, even if the tube includes two or three bent portions, or more, it is possible to easily insert the nozzle into the inner part of the tube. Accordingly, the cleaning range can be extended.

(2) Since the nozzle has a first injection hole and the nozzle supporting body has second injection holes, the cleaning force is doubled by the multiplicative effect of the both injection holes.

(3) Since elongated nozzle guide member is attached to the nozzle, it is possible to easily guide the nozzle along the inner peripheral wall of the tube.

What is claimed is:

1. A cleaning device for a tube, comprising a nozzle supporting body (13) fixedly attached to an insertion end portion of a cleaning hose (12) adapted to be inserted into said tube (11), a nozzle (18) supported by said nozzle supporting body (13) on an end opposite form said cleaning hose, said nozzle including a nozzle rotatable head portion 18*b*, at least one first ejection hole in said nozzle rotatable head portion perpendicular to a nozzle introduction passage 21 in said rotatable head portion along an axis of said nozzle support body and toward an inner wall of said tube, an elongated flexible nozzle guide member fixedly attached by one end to said nozzle rotatable head portion, said elongated nozzle guide member including a rotatable slide member on an end not attached to said nozzle rotatable head portion, a plurality of second injection holes formed in an oblique direction away from said rotatable head portion in a tubular portion of said nozzle supporting body so as to provide a water flow under pressure to permit said cleaning device to be self-propelled, whereby said slide member is slidably and rotatably guided on the inner peripheral wall of said tube for movement along the length of the tube for cleaning the same.

2. A cleaning device as set forth in claim 1 in which said nozzle supporting body includes a chamber having a greater distance than a flow passage through said hose from which said oblique second injection holes extend.

3. A cleaning device as set forth in claim 2 in which said nozzle supporting body includes an axial passage which is much smaller than a flow passage through said hose in order to build up water pressure emerging through the at least one first ejection hole.

4. A cleaning device as set forth in claim 3 in which said nozzle rotatable head portion is secured to said nozzle supporting body by use of a tubular supporting cap 22 which also supports bearings in which said nozzle rotatable head portion rotates.

* * * * *